US008242695B2

(12) United States Patent
Sumitomo et al.

(10) Patent No.: US 8,242,695 B2
(45) Date of Patent: Aug. 14, 2012

(54) LASER DRIVEN LIGHT SOURCE

(75) Inventors: Taku Sumitomo, Hyogo (JP); Yukio Yasuda, Hyogo (JP); Toshio Yokota, Hyogo (JP)

(73) Assignees: Ushio Denki Kabushiki Kaisha, Tokyo (JP); Energetiq Technology, Inc. MA (US)

( * ) Notice: Subject to any disclaimer, the term of this patent is extended or adjusted under 35 U.S.C. 154(b) by 0 days.

(21) Appl. No.: 12/662,352

(22) Filed: Apr. 13, 2010

(65) Prior Publication Data

US 2010/0264820 A1 Oct. 21, 2010

(30) Foreign Application Priority Data

Apr. 15, 2009 (JP) ..... 2009-098598
Nov. 2, 2009 (JP) ..... 2009-251900

(51) Int. Cl.
*H01J 17/20* (2012.01)
*H01J 17/30* (2006.01)
*H05G 2/00* (2006.01)

(52) U.S. Cl. ..... 313/639; 250/504 R; 313/601

(58) Field of Classification Search ..... 313/639–642; 250/504 R
See application file for complete search history.

(56) References Cited

U.S. PATENT DOCUMENTS 4,152,625 A * 5/1979 Conrad ..... 315/111.71
7,705,331 B1 * 4/2010 Kirk et al. ..... 250/493.1
2003/0020403 A1 * 1/2003 Okubo et al. ..... 313/574
2005/0167618 A1 * 8/2005 Hoshino et al. ..... 250/504 R
2007/0228288 A1 10/2007 Smith
2007/0228300 A1 10/2007 Smith
2009/0032740 A1 * 2/2009 Smith et al. ..... 250/503.1

FOREIGN PATENT DOCUMENTS

JP 61-193358 A 8/1986

* cited by examiner

*Primary Examiner* — Karabi Guharay
*Assistant Examiner* — Michael Santonocito
(74) *Attorney, Agent, or Firm* — Rader, Fishman & Grauer PLLC

(57) ABSTRACT

An laser driven light source comprises a bulb that encloses a discharge medium, a laser beam unit for emitting a laser beam, wherein the laser beam is focused in the bulb for generating a discharge, and a beam shield element that is provided in the bulb to shield peripheral devices from the laser beam, which passes through the discharge generated in the bulb.

17 Claims, 13 Drawing Sheets

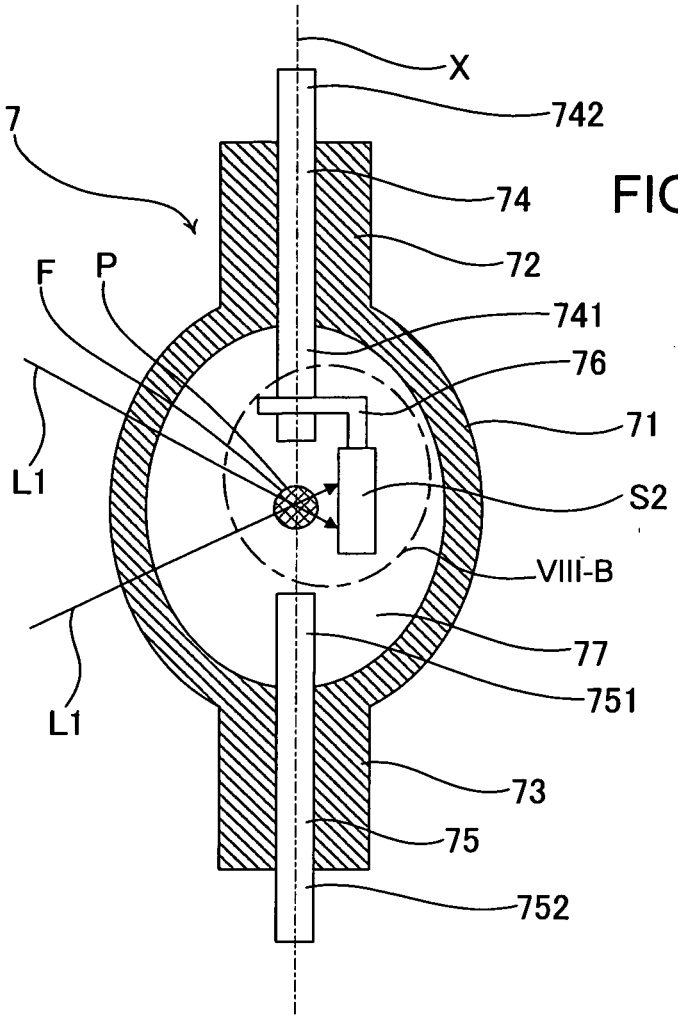
FIG. 8A
FIG. 8B
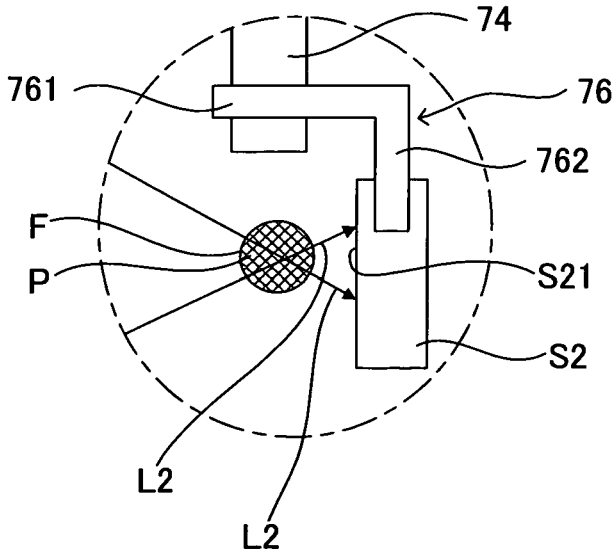

LASER DRIVEN LIGHT SOURCE

CROSS-REFERENCES TO RELATED APPLICATION

This application claims priority from Japanese Patent Application Serial Nos. 2009-098598 filed Apr. 15, 2009 and 2009-251900 filed Nov. 2, 2009, the contents of which are incorporated herein by reference in their entireties.

TECHNICAL FIELD

The present invention relates to a laser driven light source. Specifically, the present invention relates to a laser driven light source used as a light source of an exposure apparatus for an exposure process of a semiconductor, a liquid crystal substrate and a color filter, an image projection apparatus for digital cinema, and a spectrophotometer.

BACKGROUND

In recent years, in addition to the sufficient emission intensity of light of a desired wavelength band, a long life is required for such a light source used for the above mentioned exposure apparatus for an exposure process, the image projection apparatus for digital cinema, and the spectrophotometer. Although in such a light source used in the field, arc discharge is generated between electrodes in a glass bulb that encloses mercury, rare gas (xenon gas), or both, since the electrodes are exposed to the arc discharge, they become extremely high in temperature, so that gradual evaporation thereof cannot be avoided. The problem is that the emission intensity and the light source spectrum changes gradually with the passage of lighting time, since metal evaporated from the electrodes adheres to the surface of a bulb wall so that the transmittance in the ultraviolet region of the bulb changes.

Conventionally, various measures to such a problem have been considered. For example, as shown in FIG. 7 of US Patent Application Publication No. 2007/0228300, in a laser driven light source, a laser beam from the outside is focused on gas enclosed in a quartz bulb, so as to generate plasma by exciting the enclosed gas with the laser beam to obtain a light source in which the emission intensity whose spectrum distribution according to the ingredient composition of the enclosed gas, and the luminescence center position thereof is stable.

While the laser driven light source of US Patent Application Publication No. 2007/0228300 irradiates, with the laser beam, the electric discharge gas enclosed in the quartz bulb so as to excite the electric discharge gas, thereby generating high temperature plasma, which is also irradiated with laser beam. However, all the laser beam that high temperature plasma is irradiated, is not absorbed in the high temperature plasma, and the portions of the laser beam that passes through the high temperature plasma is frequently emitted, together with light emitted from the quartz glass. It has been confirmed that the intensity of the laser beam which passes through the high temperature plasma is so high with respect to the light emitted from the quartz bulb that it cannot be ignored. Therefore, there is a possibility that peripheral devices of the laser driven light source are exposed to and destroyed by the laser beam, which passes through the high temperature plasma. However, in the laser driven light source, no measure about the laser beam that passes through the high temperature plasma, has been considered.

FIG. 13 shows a basic configuration diagram of a conventional laser driven light source, which is disclosed in Japanese Patent Application Publication No. S61-193358. A laser driven light source 130 shown in FIG. 13 is equipped with a laser oscillator 131, which oscillates (generates) a pulse-like laser beam, optical system components 132 and 133, which are suitably shaped and transmit the laser beam, an optical system component 134 for light focusing, which focuses the transmitted laser beam at a focal point in a bulb 135, the bulb 135, which encloses rare gas such as xenon gas, argon gas, or mercury vapor, etc., and a catoptric system component 136 for making the laser beam, which passes through the bulb 135, enter into the bulb once again.

In this laser driven light source 130, the laser beam from the laser oscillator 131 is suitably shaped by the optical system components 132 and 133, transmitted on the predetermined optical path, and focused by the optical system component 134 for light focusing, so as to be focused at the focal position in the bulb 135. At the focal point of the bulb 135, the enclosed gas is made into plasma by the strong electric field (high energy density) of the laser beam, and radiation of the spectrum, which includes ultraviolet rays, is made from the plasma. The laser beam, which does not contribute to the plasma generation, enters onto the catoptric system component 136, reflected thereon, and focused again at the focal point in the bulb 135.

Since there is no electrode in the bulb of the laser driven light source 130, neither the emission intensity nor the spectrum changes by evaporation or influence of sputtering, so that a life span thereof is long. In addition, since in the laser driven light source 130, the center position of the light emission is determined by the focal position of the laser beam from the outside, does not change even the bulb is replaced. and can be always maintained stably. The laser driven light source 130 is useful with respect to these aspects.

SUMMARY

However, since most of the mercury enclosed in the bulb 135 has not evaporated at start-up time of the laser driven light source 130 shown in FIG. 13, the mercury vapor pressure in the bulb 135 is very low. In addition, since in the conventional laser driven light source 130, electrodes are eliminated from the inside of the bulb 135, it is not possible to fully evaporate the mercury in the bulb 135, so that the mercury vapor pressure in the bulb 135 cannot be increased.

For these reasons, in the conventional laser driven light source 130, there is a problem that the intensity of light emitted to the outside of the bulb 135 due to the mercury is very low, and most of the laser beam that is focused at the focal point in the bulb 135 is not absorbed in the mercury vapor, thereby being emitted to the outside of the bulb 135.

However, no examination has been made with regards to the above-described problem attributing to the low mercury vapor pressure in the bulb 135 of the laser driven light source 130 shown in FIG. 13. It is also thought that the above-mentioned problem naturally arises not only when mercury is enclosed in the bulb 135 as light emission metal, but also when light emission metal other than the mercury is enclosed in the bulb 135.

In view of the above, it is an object of the present invention to provide a shield from a laser beam, which passes through plasma generated in a bulb without being absorbed therein, in a laser driven light source in which the laser beam is focused on discharge medium enclosed in the bulb so that the discharge medium is excited, thereby generating the plasma.

Moreover, it is an another object of the present invention to form a stable plasma in a bulb while maintaining a high vapor pressure value of the light emission metal vapor, wherein the laser beam is focused on the light emission metal enclosed in the bulb so that it is excited into a vapor, thereby generating the plasma.

One of the aspects of the present invention is a laser driven light source including a bulb that encloses a discharge medium, wherein plasma is generated in the bulb by a laser beam focused in the bulb, and a beam shield element is provided within the bulb so as to provide a shield from the laser beam that passes through the plasma generated in the bulb.

In the laser driven light source, the discharge medium may be made of metal. The beam shield element is heated by absorbing the laser beam, which passes through the plasma generated in the bulb.

In the laser driven light source, a beam damper may be provided on the beam shield element, so that the beam damper may absorb the laser beam, which passes through the plasma generated in the bulb, by reflection thereinside.

In the laser driven light source, a surface of the beam shield element may be modified for increasing thermal emissivity thereof.

In the laser driven light source, the beam shield element may have a concave-convex surface, wherein a concave-convex pitch thereof is in a range of 1 μm-1 mm.

In the laser driven light source, tungsten powder may be sintered on the surface of the beam shield element, which is irradiated with the laser beam passing through the plasma generated in the bulb.

In the laser driven light source, the beam shield element may be made of one or more metals of tungsten, molybdenum, tantalum, and rhenium.

In the laser driven light source, the discharge medium enclosed in the bulb may contain mercury.

In the laser driven light source, the discharge medium enclosed in the bulb may contain mercury and one or more rare gases.

In the laser driven light source, the beam shield element may be held by a support element, wherein the support element is arranged in the bulb so as to project therein.

In the laser driven light source, a pair of electrodes may be provided so as to face each other in the bulb.

In the laser driven light source, the beam shield element may be held by the support element fixed to the electrode.

In the laser driven light source, the beam shield element may have a reflection surface for reflecting the laser beam passing through the plasma generated in the bulb.

In the laser driven light source, the reflection surface of the beam shield element may have a scattering reflection characteristic.

In the laser driven light source, a beam absorption element may be provided outside the bulb, so that the laser beam reflected on the reflection surface of the beam absorption element may be absorbed thereby.

In the laser driven light source, a concave reflecting mirror for reflecting light emitted from the plasma is provided, so that the plasma is located at a focus point of the concave reflecting mirror.

In the laser driven light source, the concave mirror may have an aperture through which the laser beam passes, and an optical element for focusing the laser beam in the bulb is provided nearby the aperture.

The laser beam irradiates the discharge medium enclosed in the bulb so that the laser driven light source according to the present invention may generate and maintain plasma in the bulb. Since the beam shield element is provided in the bulb, the portions of the laser beam that pass through the plasma without being absorbed by the plasma generated in the bulb can be certainly blocked, whereby there is no possibility that peripheral devices of the laser driven light source are exposed to and destroyed by those portions that pass through the plasma.

Furthermore, since the beam shield element of the laser driven light source according to the present invention, which absorbs the laser beam passing through the plasma generated at the focal point in the bulb thereby generating heat, is provided in the bulb, when the discharge medium enclosed in the bulb is metal, the effects set forth below are acquired. The beam shield element, which absorbs the laser beam thereby generating heat, emits light of an infrared to far-infrared wavelength band towards the bulb according to Planck's law, thereby radiationally-heating the bulb to a higher temperature and raising the vapor pressure of the metal enclosed in the bulb. In this state, the metal in the bulb is certainly excited so that stable plasma is generated in the focal position in the bulb by the laser beam focused in the bulb. Therefore, in the laser driven light source according to the present invention, an output of the light that is emitted from the plasma generated in the bulb can be stabilized at a high value.

BRIEF DESCRIPTION OF DRAWINGS

Other features and advantages of the present laser driven light source will be apparent from the ensuing description, taken in conjunction with the accompanying drawings, in which:

FIGS. 3A and 3B are diagrams showing a modified example of a laser driven light source according to a first embodiment of the present invention, wherein FIG. 3B is a partially enlarged view of III-B portion of FIG. 3A;

FIGS. 4A and 4B are diagrams showing another modified example of a laser driven light source according to a first embodiment of the present invention, wherein FIG. 4B is a partially enlarged view of IV-B portion of FIG. 4A;

FIGS. 8A and 8B are enlarged views of a bulb of a laser driven light source shown in FIG. 7, wherein FIG. 8B is a partially enlarged view of VIII-B portion of FIG. 8A;

FIGS. 12A and 12B are enlarged views of a bulb of a laser driven light source shown in FIG. 11, wherein FIG. 12B is a partially enlarged view of XII-B portion of FIG. 12A.

DESCRIPTION

First Embodiment

Figure 1:
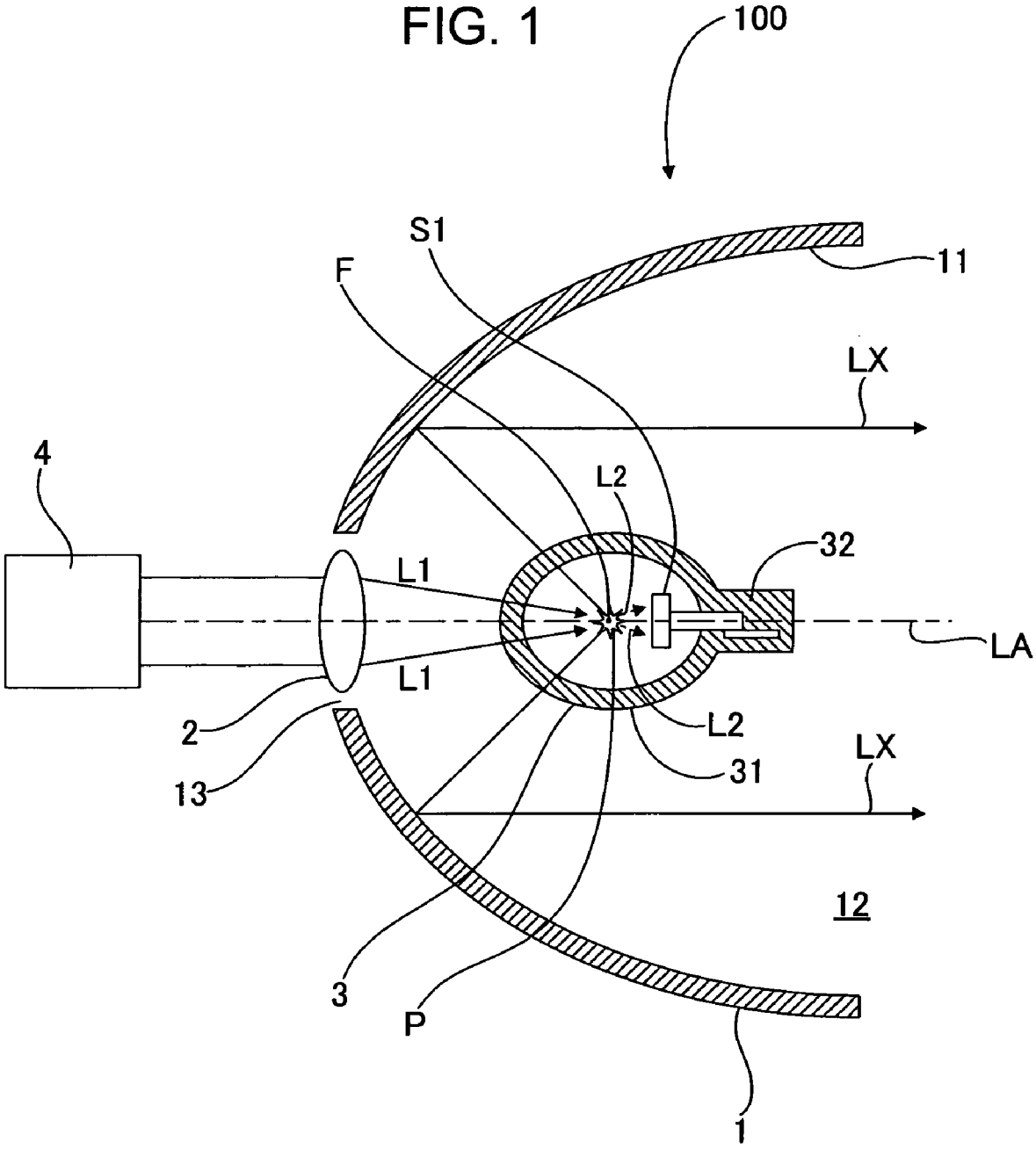
FIG. 1 shows a basic configuration diagram of a laser driven light source according to a first embodiment of the present invention.

FIG. 1 shows a basic configuration diagram of a laser driven light source according to a first embodiment of the present invention. The laser driven light source according to the present embodiment is a non-electrode type light source, which does not have any electrodes in a bulb. Moreover, the laser driven light source according to the present embodiment is equipped with a beam shield element, which functions to absorb the laser beam that passes through the plasma without being absorbed by the plasma.

The laser driven light source 100 is made up of a bowl-shaped concave reflecting mirror 1, which is arranged so that the circumference of a bulb 3 may be surrounded thereby and has a light emission aperture 12, an optical system component 2 for focusing a laser beam L1 at a focal point F in the bulb 3, which is arranged to agree with the focal point F of the concave reflector 1 and encloses an discharge medium, and a laser source 4, which emits the continuous or pulsed laser beam towards the bulb 3. The laser beam L1, which is emitted from the laser source 4, is focused at the focal point F of the concave reflecting mirror 1 by the optical system component 2 so that the discharge medium enclosed in the bulb 3 is excited by the laser beam L1, thereby generating plasma P.

The bulb 3 has a sealed space 35 having a spheroidicity shape, wherein, for example, mercury is enclosed as an discharge medium in the sealed space 35. The amount of mercury enclosed in the bulb 3 is 2-70 mg/cc. In addition to the mercury, metal such as cadmium, zinc, and tin can also be enclosed as the discharge medium. Since the bulb 3 is arranged with respect to the concave reflecting mirror 1 so that a sealing portion 32 may be located in a side of the light emission aperture 12 of the concave reflecting mirror 1, the laser beam L1 is not blocked by the sealing portion 32. The concave reflecting mirror 1 is made up of, for example, a reflective surface 11 having a paraboloid-of-revolution shape, the light emission aperture 12 for letting out light, which the plasma P emits, to the outside of the concave reflecting mirror 1, and a back side aperture 13 for introducing the laser beam L1 into the inside of the concave reflecting mirror 1, wherein the light, which the plasma P generated at the focal point F emits, is reflected thereby in a front direction (rightward on the figure), and is emitted as parallel light from the light emission aperture 12. The reflective surface 11 is made up of a dielectric multilayer film, which reflects the light LX that the bulb 3 emits. The reflective surface 11 is made up of the dielectric multilayer film, which is formed by, for example, laminating, by turns, a layer which consists of high refractive-index material and a layer which consists of low refractive-index material. For example, the reflective surface 11 is made up of a dielectric multilayer film formed by laminating, by turns, $HfO_2$ (hafnium oxide) and $SiO_2$ (silicon oxide) or a dielectric multilayer film formed by laminating, by turns, $Ta_2O_5$ (tantalum oxide), and $SiO_2$ (silicon oxide). In addition, the reflective surface 11 is not limited to paraboloid-of-revolution shape, and may be a spheroidicity shape.

The back side aperture 13 of the concave reflecting mirror 1 is formed to agree with the optical axis LA of the laser beam L1, and the optical system component 2 is arranged therein. The effective reflective area of the reflective surface 11 is not decreased where the back side aperture 13 is arranged on the optical axis LA of the laser beam source L1. In addition, as shown in FIG. 2 of US Patent Application Publication No. 2007/0228300, when the aperture for introducing the laser beam in the concave reflecting mirror is formed in a side face of the concave reflecting mirror, the effective reflective area thereof is decreased. The optical system component 2 is a lens, which focuses the laser beam L1 at the focal position in the bulb 3. A drive system of the laser source 4, which may be a pulse drive, a CW drive, or a combination thereof, is used to generate the laser beam L1 having sufficient intensity for excitation of the discharge medium. The laser beam L1 has a peak in the wavelength-band of visible light to infrared rays, for example, at 1.06 μm (micrometers).

Figure 2A:
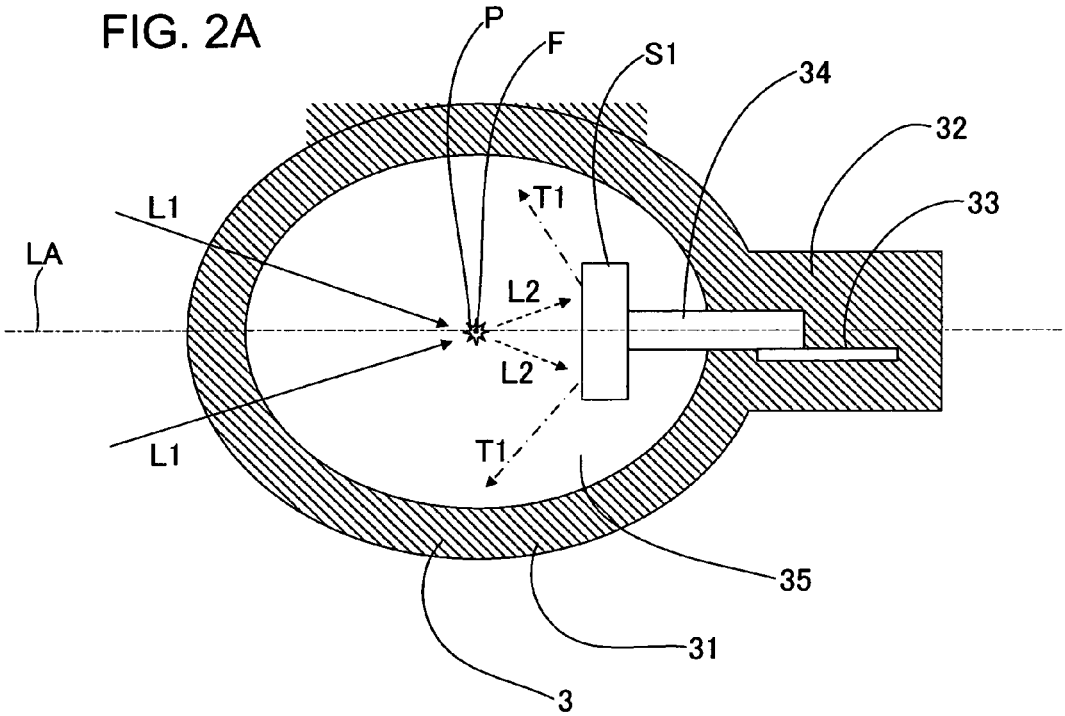
FIGS. 2A and 2B are enlarged views of a bulb of a laser driven light source shown in FIG. 1.
Figure 2B:
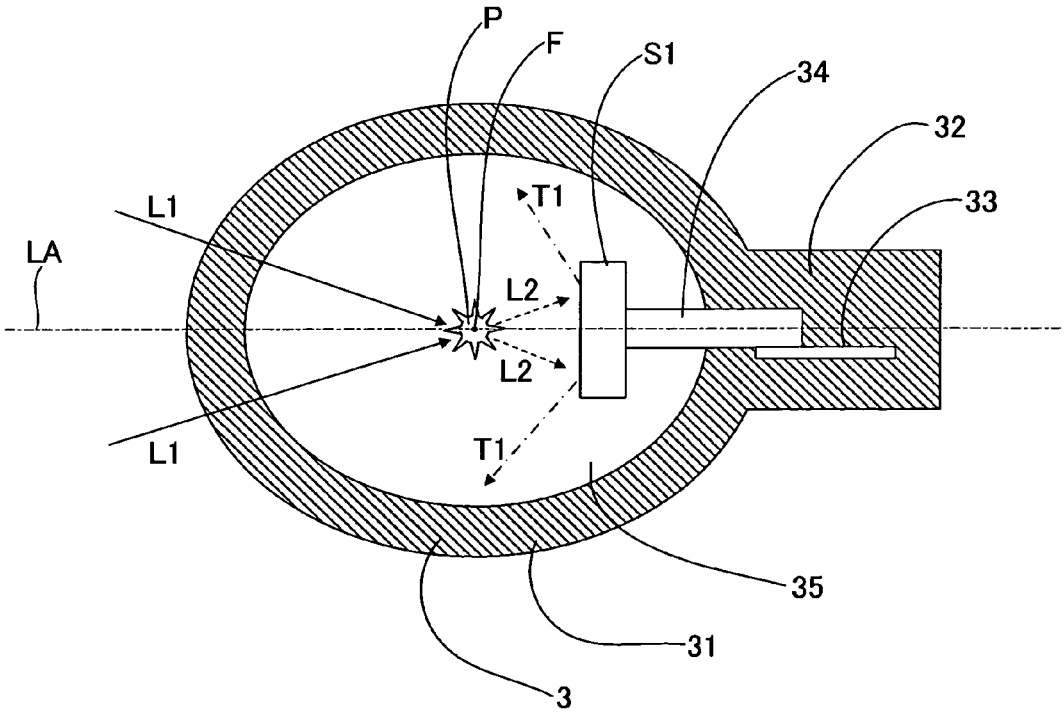

FIGS. 2A and 2B are enlarged views of the bulb 3 of the laser driven light source of FIG. 1. As shown in FIG. 2A, the bulb 3 has a light emitting section 31 that has the sealed space 35 of a spheroidicity shape in its inside and is formed in an approximately spherical shape, and a pillar-shaped sealing portion 32 that is continuously formed from an end portion of the light emitting section 31, and which is airtightly sealed by a metallic foil 33 made of, for example, molybdenum, wherein the light emitting section 31 has the sealed space 35 in its inside. In addition, in the example shown in FIGS. 2A and 2B, the sealing portion 32 is formed only at one end side of the light emitting section 31.

A support 34 for supporting the beam shield element S1 is buried in the sealing portion 32. A base portion of the support 34 is connected to the metallic foil 33, and while the tip part thereof extends into the sealed space 35, the support 34 supports the beam shield element S1 in the sealed space 35.

The beam shield element S1 arranged in the bulb 3 is a plate like member and absorbs the laser beam L2 that passes through the plasma P generated at the focal point F in the bulb 3. In order to effectively absorb the laser beam L2, which passes through the plasma P, the beam shield element S1 is arranged so as to be perpendicular to the optical axis LA of the laser beam L1, in a side of the sealing portion 32, which is located in a direction in which the laser beam L2 travels from the focal point F of the laser beam. In addition, the width of the beam shield element S1 in the direction perpendicular to the optical axis LA is suitably set up according to the incidence angle of the laser beam L1 and the distance between the focal point F of the bulb 3 and the beam shield element S1.

The beam shield element S1 is made of a substance that is excellent in heat resistance to enable without melting absorption of the portions of laser beam of the wavelength band of visible light to infrared rays emitted from the laser source 4. The substance that forms the beam shield element S1 is made of metal containing, for example, at least one of tungsten, molybdenum, tantalum, and rhenium.

Next, an operation of the laser driven light source 100 according to the first embodiment shown in FIG. 1 will be described, referring to FIGS. 2A and 2B. FIG. 2A shows a state in an early stage of start-up of the laser driven light source, and FIG. 2B shows a steady state of the laser driven light source.

Start-Up Time

First, an operation at time of start-up of the laser driven light source will be described below referring to FIG. 2A. Hereinafter, the "start-up time" is the period from the start of focusing the laser beam L1 at the focal point F in the bulb 3 until the light emission metal, which is enclosed as an discharge medium in the bulb 3, is completely evaporated. The continuous or pulsed laser beam L1, which is generated by the laser source 4, is focused at the focal point F within the bulb 3 by the optical system component 2. Since the vapor pressure of the light emission metal in the bulb 3 is very low at the start-up time of the laser driven light source, all the energy of the laser beam L1, which is focused at the focal point F, is not spent in order to generate plasma, so that a very small plasma P is formed in the focal point F within the bulb 3. That is, although most of the laser beam L1, which is focused at the focal point F within the bulb 3, passes through the focal point F, it is absorbed by the beam shield element S1, whereby it is possible to prevent the laser beam from being emitted to the outside of the bulb 3. The beam shield element S1 absorbs the laser beam L2, and generates heat, so that, as shown in FIG. 2A, heat rays T1 of the infrared ray to the far infrared ray wavelength band are radiated towards the light emitting section 31 of the bulb 3, so that the light emitting section 31 is radiationally heated, and the vapor pressure of the light emission metal enclosed in the bulb 3 is increased. With this, the plasma P formed at the focal point F within the bulb 3 becomes gradually large, so that the luminescence intensity increases gradually.

Steady State Time

Next, an operation at steady state time of the laser driven light source will be described below, referring to FIG. 2B. Hereinafter, a period during which the vapor pressure of the light emission metal within the bulb 3 becomes stable at a predetermined level, and the size of the plasma P formed at the focal point F become constant, is referred to as "steady state time." In the steady state time, the light emission metal is certainly excited by the laser beam L1 that is focused at the focal point F within the bulb 3, and the size of the plasma P formed in the focal point F converges so as to be constant whereby light of the stable intensity at a predetermined level is emitted from the plasma P. When mercury is enclosed as the light emission metal in the bulb, light of i-line with a wavelength of 365 nm is emitted to the outside of the light emitting section 31. In the steady state time, the laser beam L1 continues to irradiate the plasma P. This prevents the plasma P generated within the bulb 3 from being extinguished. Part of the laser beam L1, with which the plasma P is irradiated, passes through the focal point F, without being absorbed by the plasma P (see L2 of FIG. 2B). For example, when the bulb is irradiated with a 1 kW YAG laser, the output of the laser beam L2, which passes through the plasma P, is about 150 W. The laser beam L2, which passes through the plasma P, is absorbed by the beam shield element S1. The beam shield element S1 absorbs the laser beam L2 thereby generating heat, so that as shown in FIG. 2B, heat rays T1 of infrared ray to far infrared ray wavelength band are radiated towards the light emitting section 31 of the bulb 3, so that the light emitting section 31 of the bulb 3 is radiationally heated. Since at steady state time, the light emitting section 31 of the bulb 3 always becomes high in temperature, which evaporates the light emission metal completely and stabilizes the vapor pressure at a high value, the laser beam L1 is certainly absorbed by the light emission metal. Therefore, the plasma P generated in the bulb 3 is not extinguished, so that a specific light intensity, which is stabilized at a predetermined level, is emitted from the plasma P.

Thus, since, the laser driven light source 100 according to the present invention has the beam shield element S1, which absorbs the laser beam L2 passing through the plasma P generated in the bulb 3, the effects set forth below are acquired. First of all, since the laser beam L2 that passes through the plasma P generated in the bulb 3 is certainly blocked by the beam shield element S1, there is no possibility that peripheral devices of the laser driven light source 100 are exposed to the laser beam L2, which passes through the plasma P generated in the bulb 3, so that they may be destroyed. Secondly, the beam shield element S1 absorbs the laser beam L2, which passes through the plasma P without being absorbed by the plasma P, and generates heat, so that the vapor pressure of the light emission metal as the discharge medium enclosed in the bulb 3 is rapidly increased and stabilized at a high value. Therefore, the plasma P generated in the bulb 3 is not extinguished thereby being maintained, so that light with a stable output can be emitted from the plasma P.

Figure 3A:
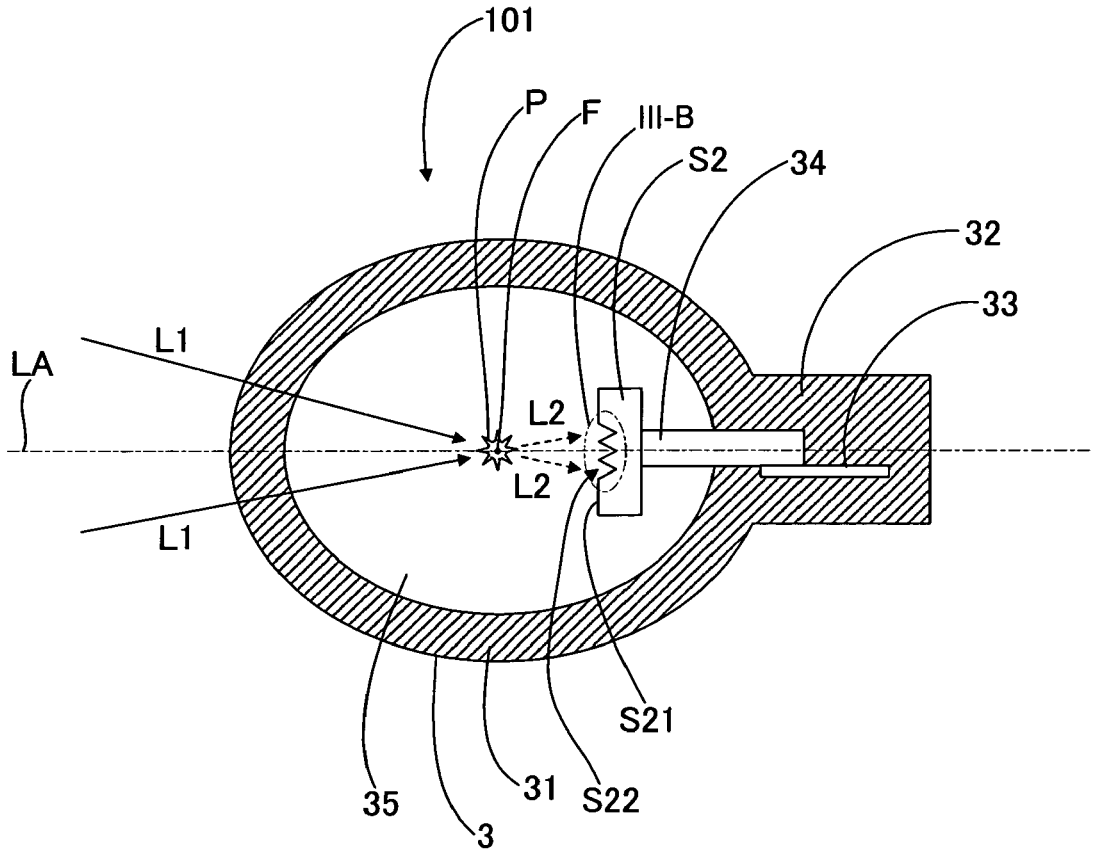
Figure 3B:
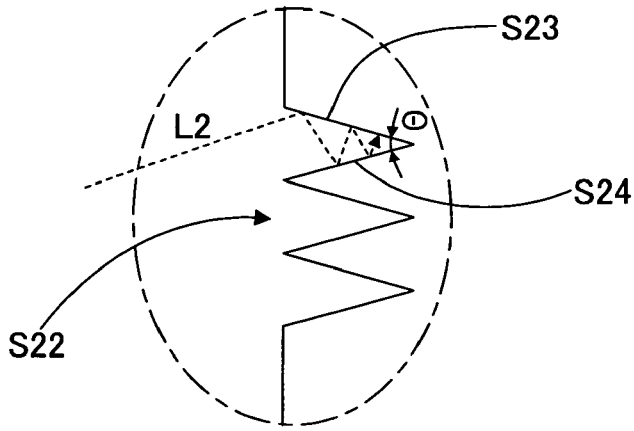

FIGS. 3A and 3B show cross sectional views of a modified example of the laser driven light source according to the first embodiment of the present invention. FIG. 3B is a partially enlarged view of a portion III-B of FIG. 3A. Since a laser source and an optical system component thereof are the same as those of the laser driven light source shown in FIG. 1, they are not shown in the figures, while only a bulb is shown therein. Since a laser driven light source 101 of FIGS. 3A and 3B has the same structure as that of the laser driven light source 100 according to the first embodiment, except the shape of a beam shield element S2 is different from that of the beam shield element S1 shown in FIGS. 1, 2A, and 2B, in FIGS. 3A and 3B, the same numerals as those of FIGS. 1, 2A, and 2B are assigned to the same elements as those of FIGS. 1, 2A, and 2B, and the description of those same elements is omitted.

As shown in FIG. 3A, two or more V-shaped beam dampers S22, each of which becomes narrower in width gradually toward the inner side of the beam shield element S2, are formed on a surface S21 of a side of the beam shield element where the laser beam L2, which passes through the plasma P, is irradiated. As shown in FIG. 3B, since carbon black is applied to reflective faces S23 and S24 of each beam damper, or fine-grained tungsten powder applied to the reflective faces S23 and S24 thereof is sintered, the beam dampers S22 can effectively imbibe and decrease the laser beams L2, which enters the beam dampers S22. In addition, the angle Θ of each beam damper S22 is set so that the laser beam L2 may not come out to the outside of the beam damper S22 without being absorbed thereby. As described above, the beam shield element S2 has the structure in which the two or more beam dampers S22 are formed on the surface S21 of a side of the beam shield element where the laser beam L2 is irradiated, so that the laser beam L2 that passes through the plasma P within the bulb 3 is absorbed efficiently, thereby easily generating heat.

Description of a function of the beam damper S22 of the beam shield element S2 is given below. As shown in FIG. 3B, when the laser beam L2, which passes through the plasma P, is irradiated to one reflective face S23 of the beam damper S22, the laser beam L2, which cannot be absorbed in the one reflective face S23 of the beam damper, is reflected towards the other reflective face S24 of the beam damper S22. As described above, the angle Θ of the beam damper S22 is set so that the laser beam L2, which enters there, may not come out to the outside of the beam damper S22. Therefore, the laser beam L2, which enters the inside of the beam damper S22, is reflected many times and guided toward the inner side of the beam damper S22, and is finally absorbed completely by the beam damper S22. As mentioned above, in the laser driven light source 101 shown in FIGS. 3A and 3B, the two or more beam dampers S22 are formed on the surface S21 located in a side of the beam shield element S2 where the laser beam L2 is irradiated. Since the beam damper S22 absorbs efficiently the laser beam L2 that passes through the plasma P generated at the focus F in the bulb 3, the beam shield element S2 generates heat easily. The heat rays T1 of infrared ray to far infrared ray wavelength band are radiated towards the light emitting section 31 of the bulb 3, so that the light emitting section 31 of the bulb 3 is radiationally heated. Therefore, since the vapor pressure of the light emission metal in the bulb 3 is more rapidly increased and stabilized easily at a high value, the plasma P generated in the bulb 3 is not extinguished so that the plasma P is maintained, and light with a stable output can be emitted from the plasma P. In addition, the beam shield element S2 is not limited to the structure having the V-shaped beam dampers S22 shown in FIGS. 3A and 3B, which absorb the laser beam passing through the high temperature plasma P. The beam shield element S2 may be an element formed by, for example, performing black alumite processing or applying carbon black to a surface of a substrate made of a high melting point metal, or may be an element formed by ceramic board containing organic dye or organic pigment. Moreover, the beam shield element S2 may be an element formed by sintering the fine-grained tungsten powder applied to a surface of the beam shield element S2. In such a way, the effectual surface area of the beam shield element S2 is increased, so as to absorb the laser beam L2, which passes through the plasma P generated within the bulb 3, thereby easily generating heat. Therefore, the light emission section 31 of the bulb 3 can be effectively radiationally heated.

Figure 4A:
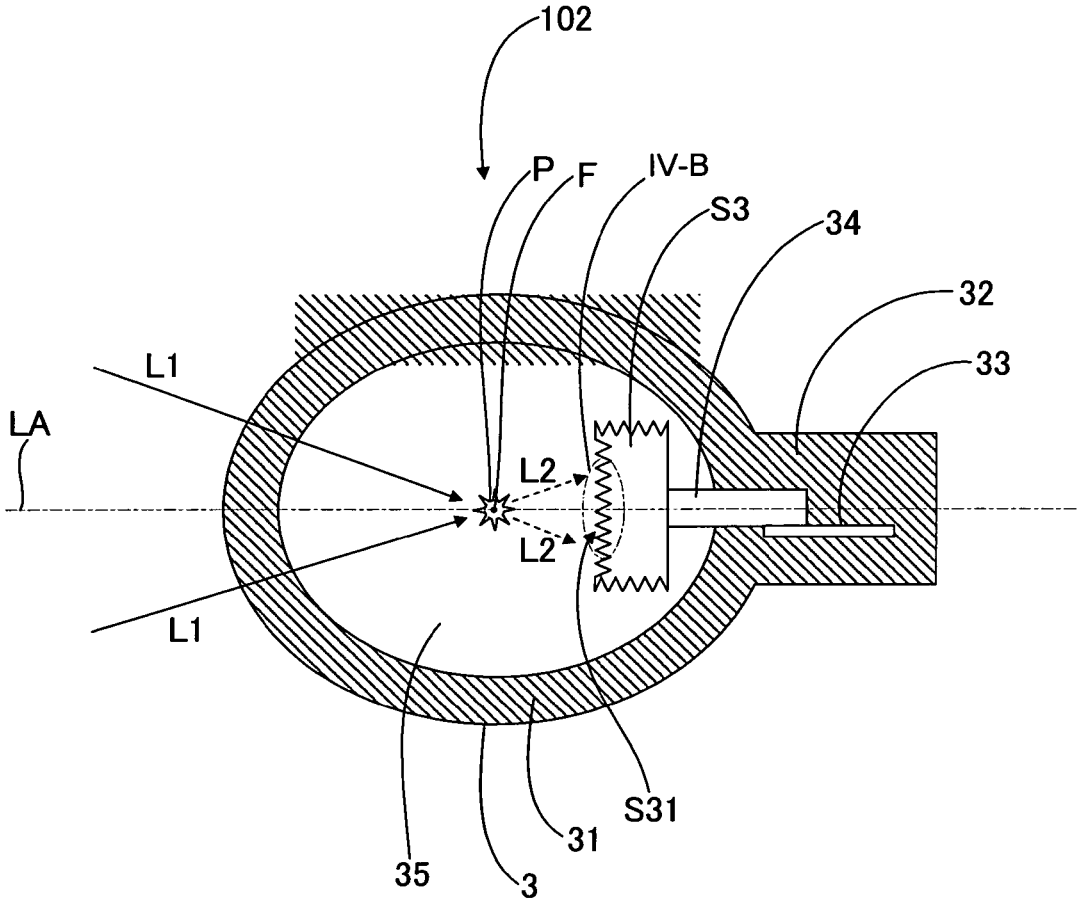
Figure 4B:
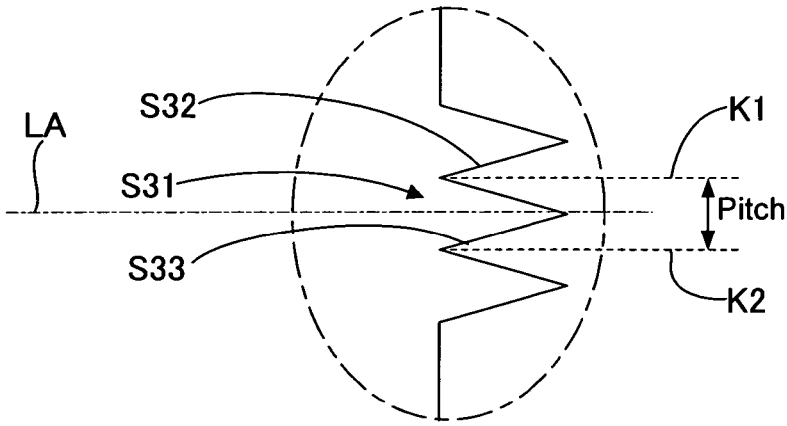

FIGS. 4A and 4B are cross sectional views of another modified example of the laser driven light source according to the first embodiment. FIG. 4B is a partially enlarged view of the portion VI-B of FIG. 4A. Since a laser source and an optical system component thereof are the same as those of the laser driven light source shown in FIGS. 1A and 1B, they are not shown in these figures and only a bulb is shown therein. Since a laser driven light source 102 of FIGS. 4A and 4B has the same structure as that of the laser driven light source 100 according to the first embodiment, except the shape of a beam shield element S3 is different from the beam shield element S1 shown in FIGS. 1, 2A and 2B, in FIGS. 4A and 4B, the same numerals as those of FIGS. 1, 2A and 2B are assigned to the same elements as those of FIGS. 1, 2A and 2B, and the description of those same elements is omitted.

As shown in FIG. 4A, a concavo-convex portion S31 having fine concaves and convexes is formed on a surface of the beam shield element S3. The portion S31 of the fine concaves and convexes increases the surface area of the beam shield element S3, and efficiently absorbs the laser beam L2 which passes through the plasma P, thereby accelerating thermal radiation from the beam shield element S3. A concave-convex pitch thereof is in a range of 1 μm-1 mm. As shown in FIG. 4B, the concavo-convex pitch means a distance between a pair of virtual lines K1 and K2, which pass through the respective peaks of a convex part S32 and a convex part S33 of the concavo-convex portion S31, the convex part S32 and the convex part S33 being adjacent to each other, and which extend in parallel with an optical axis LA of the laser beam.

Figure 5:
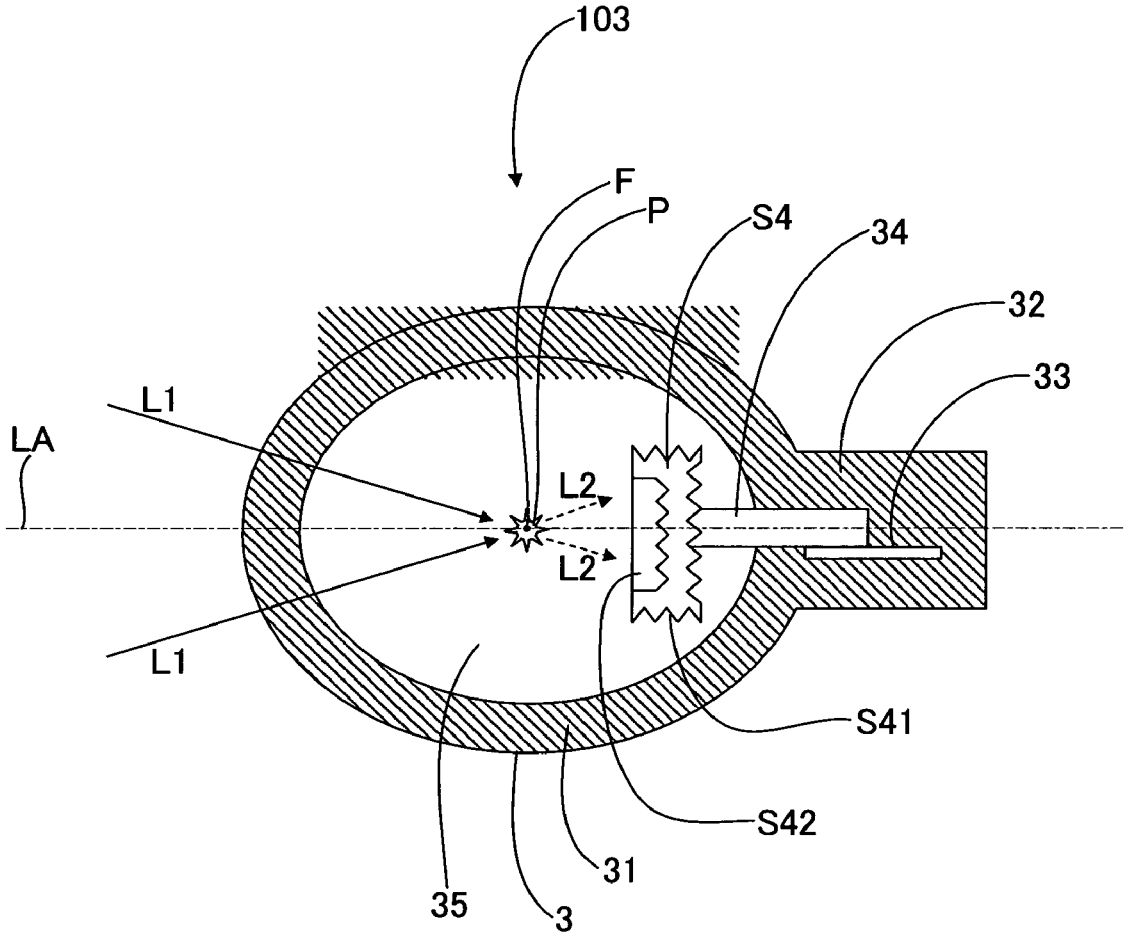
FIG. 5 is a diagram showing still another modified example of a laser driven light source according to a first embodiment of the present invention.

FIG. 5 is a diagram showing another modified example of the laser driven light source according to the first embodiment. Since a laser source and an optical system component thereof is the same as those of the laser driven light source shown in FIGS. 1A and 1B, they are not shown in the figure. Since a laser driven light source 103 of FIG. 5 has the same structure as that of the laser driven light source 100 according to the first embodiment, except the shape of a beam shield element S4 is different from that of the beam shield element S1 shown in FIGS. 1, 2A, and 2B, in FIG. 5, the same numerals as those of FIGS. 1, 2A, and 2B are assigned to the same elements as those of FIGS. 1, 2A, and 2B, and the description of those same elements is omitted.

As shown in FIG. 5, a concavo-convex portion S41 having fine concaves and convexes is formed over the entire surface of the beam shield element S4, and a cylindrical concave portion S42 is formed on a face of a side, which receives the laser beam L2. The portion S41 of the fine concaves and convexes increases the surface area of the beam shield element S4, and efficiently absorbs the laser beam L2, which passes through the plasma P generated at the focal point F of the bulb 3, thereby accelerating thermal radiation from the beam shield element S4. The cylindrical concave portion S42 increases the surface area of the beam shield element S41 and trims the weight of the beam shield element S4. A concavo-convex pitch thereof is in a range of 1 μm-1 mm, as well as that of the concavo-convex portion S41 of the beam shield element S4.

Figure 6:
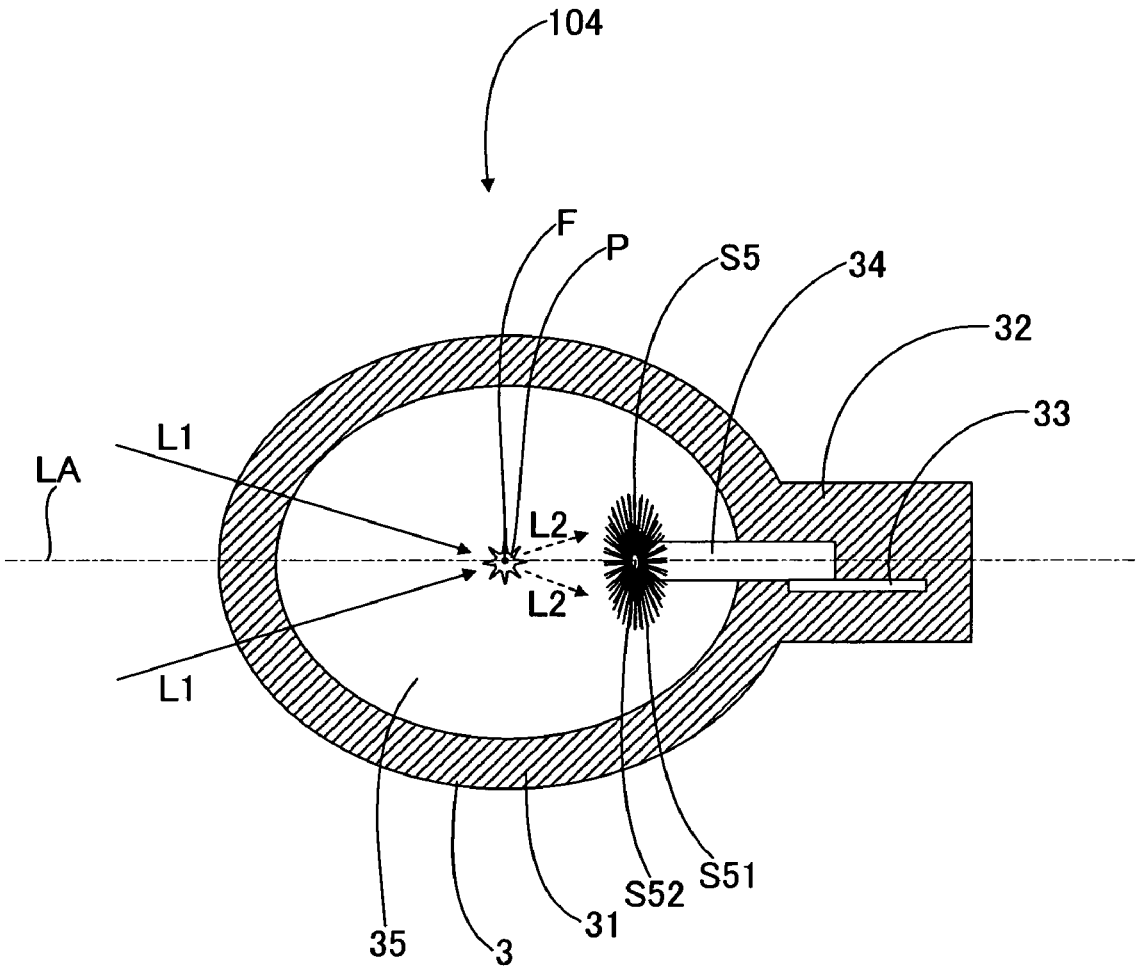
FIG. 6 is a diagram showing still another modified example of a laser driven light source according to a first embodiment of the present invention.

FIG. 6 is a cross sectional view of a still another modified example of the laser driven light source according to the first embodiment. Since a laser source and an optical system component thereof are the same as those of the laser driven light source shown in FIGS. 1A and 1B, they are not shown in the figure. Since a laser driven light source 104 of FIG. 6 has the same structure as that of the laser driven light source 100 according to the first embodiment, except the shape of a beam shield element S5 is different from that of the beam shield element 51 shown in FIGS. 1, 2A, and 2B, in FIG. 6, the same numerals as those of FIGS. 1, 2A, and 2B are assigned to the same elements as those of FIGS. 1, 2A, and 2B, and description of the same elements is omitted.

As shown in FIG. 6, the beam shield element S5 of the laser driven light source 104 is formed in a shape of a scrub brush, which has a multiple line shaped portion S51, having a large number of line parts and radially extending in a diameter outside direction from a center S52 located on an optical axis LA of a laser beam L1. The multiple line shaped portion S51 increases the surface area of the beam shield element S5, and efficiently absorbs the laser beam L2, which passes through the plasma P, thereby accelerating thermal radiation from the beam shield element S5.

As described above, the beam shield elements S2 through S5 of the laser driven light sources 101 through 104 shown in FIGS. 3A, 3B, 4A, 4B, 5, and 6, have respectively the structure for increasing the surface area thereof. Therefore, the laser beam L2, which passes through the plasma P, is efficiently absorbed thereby generating heat so that the light emission section 31 of the bulb 3 is efficiently radiationally heated. Accordingly, since the vapor pressure of the light emission metal in the bulb 3 is rapidly increased and then stabilized at a high value by the laser driven light source 101 through 104, the plasma P generated in the bulb 3 is not extinguished so that the plasma P is maintained, whereby light with a stable output can be emitted from the plasma P.

Second Embodiment

Figure 7:
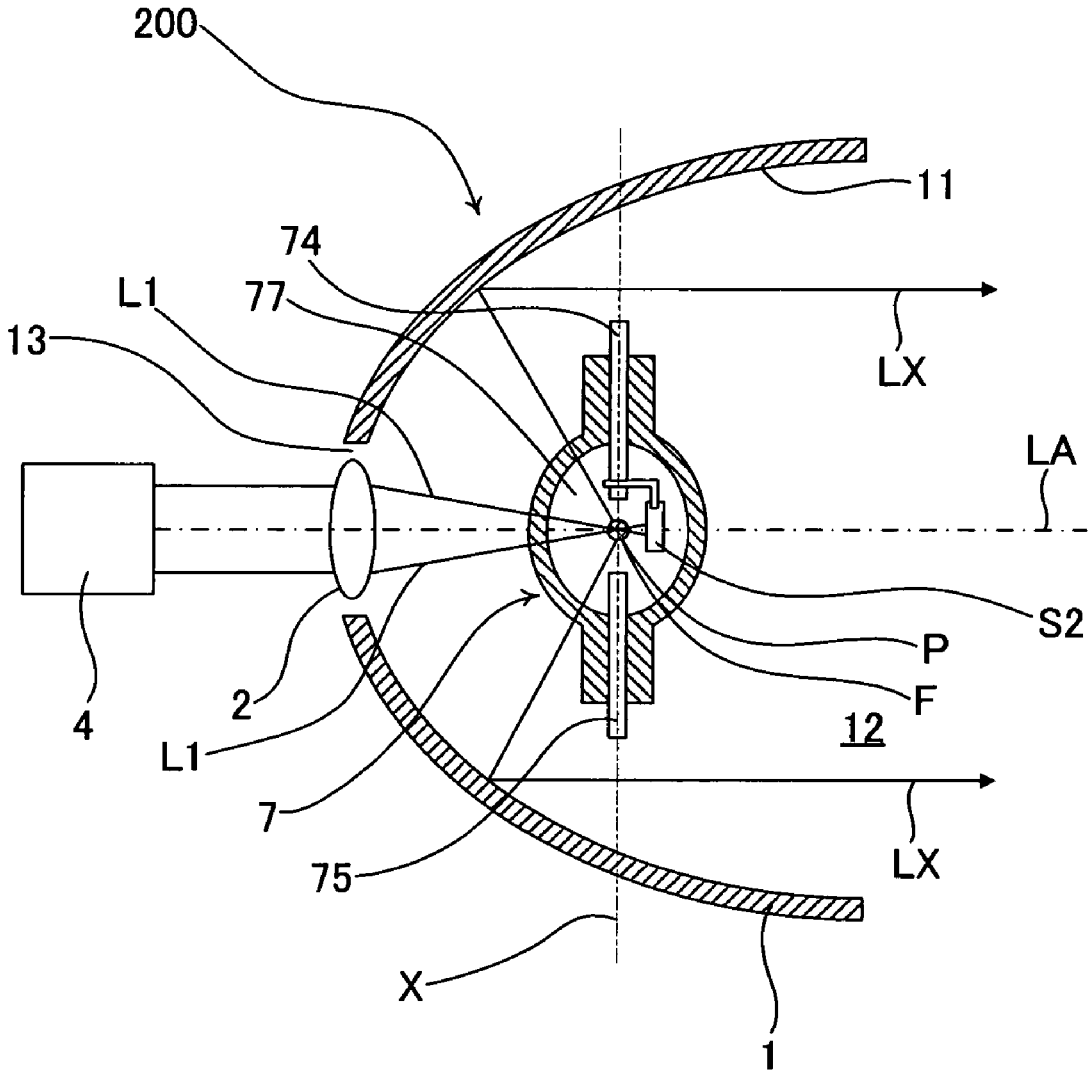
FIG. 7 shows a basic configuration diagram of a laser driven light source according to a second embodiment of the present invention.

FIG. 7 is a cross sectional view of a basic structure of a laser driven light source according to a second embodiment. The laser driven light source according to this embodiment is an electrode type light source having electrodes provided in a bulb. Moreover, the laser driven light source according to this embodiment is equipped with a beam shield element having a shield function by absorbing a laser beam, which passes through a plasma without being absorbed by the plasma. In addition, in FIG. 7, the same numerals as those of FIG. 1 are assigned to elements of the laser driven light source 200, which are the same as those of the laser driven light source 100 of FIG. 1 and the description of those same elements is omitted.

The laser driven light source 200 is made up of a concave reflecting mirror 1, which is formed in a bowl-shaped; an optical system component 2 for focusing a laser beam L1, which a laser source 4 emits; a bulb 7, which is arranged at the focal point F of the reflecting concave reflector 1 so that a tube axis X of the bulb 3 is perpendicular to an optical axis LA of the concave reflecting mirror 1; and the laser source 4, which emits the laser beam L1 towards the bulb 3. As shown in the figure, in the laser drive light source 200, the laser source 4, the optical system component 2 and the bulb 7 are arranged in a straight line, in that order, on the optical axis LA of the laser beam L1.

FIG. 8A is an enlarged cross sectional view of the bulb 7 of the laser driven light source 200 shown in FIG. 7. The bulb 7 comprises an approximately spherical light emission section 71 made of silica glass; rod shaped sealing portions 72 and 73, which continuously respectively extend in a tube-axis direction X from both ends thereof; a sealed space 77 of a spheroidicity shape, which is formed in the inside of the light emission section 71; rod shaped electrodes 74 and 75, which are buried in the respective sealing portions 72 and 73; a beam shield element S2, which is arranged in the sealed space 77 and absorbs and blocks the laser beam that passes through a high temperature plasma P that the laser source 4 emits; and a support member 76 for fixing the beam shield element S2 to the electrode 74.

At least one kind of rare gas and mercury (vapor) are enclosed in the sealed space 77 of the bulb 7 as a discharge medium. That is, there are three combinations for the discharge medium, that is, rare gas only, mercury only, and both of them. For example, in the case where mercury is enclosed as the discharge medium, ultraviolet rays of a 356 nm wavelength, which is the light emission due to the mercury, is emitted from the bulb 12. The amount of enclosed mercury is 2-70 mg/cc. In addition to xenon gas, argon gas as rare gas, or one more kinds of halogen gases may be enclosed. In addition, cadmium, zinc, tin, etc. may also be enclosed as the discharge medium in addition to the above. The electrodes 74 and 75 are made from rod-shaped tungsten, and are airtightly buried in the sealing portions 72 and 73 respectively, by sealing the rods. One end portions 741 and 751 of the electrodes 74 and 75 project in the sealing space 77 respectively, and the electrodes 74 and 75 are arranged so as to face each other in the sealed space 77 and to be apart from each other at a predetermined distance. Moreover, the other end portions 742 and 752 of the electrodes 74 and 75 respectively extend toward the outside of the sealing portions 72 and 73, and the electrodes 74 and 75 are electrically connected to a power supply apparatus. The intermediate position of these electrodes 74 and 75 agrees with the focus point F of the concave reflecting mirror 1, as shown in FIG. 7.

The high temperature plasma P is generated at the intermediate position by impressing high voltage between the electrodes 74 and 75. Since the bulb 7 of the laser driven light source 200 according to the second embodiment has the above-mentioned electrodes 74 and 75, dielectric breakdown can easily occur between the electrodes 74 and 75 at the start-up time of the bulb 7 so that the plasma P can be easily generated at the intermediate position between the electrodes 74 and 75.

FIG. 8B is a partially enlarged view of a portion VIII-B of FIG. 8A. As shown in FIG. 8B, the beam shield element S2 is fixed to the electrode 74 by the support member 76, which is formed in a shape of hook as a whole, so as to extend in parallel to the electrodes 74 and 75, within the sealing space 77 of the light emission section 71. As shown in FIG. 8B, the support member 76 is made up of a tube-axis crossing portion 761 extending in a direction that is perpendicular to the electrode 74, and a tube-axis parallel portion 762 that is bent so as to be right-angled to the tube-axis crossing portion 761 and that extends in parallel with the electrode 74, so that the support member 76 is formed in a shape of hook as a whole. While the tube-axis crossing portion 761 is fixed to the electrode 74, the tube-axis parallel portion 762 is fixed to the beam shield element S2. The beam shield element S2 and the support member 76 are respectively made of high melting point metal, such as tungsten, tantalum, and molybdenum.

In the laser driven light source 200 according to the second embodiment, since the electrode 74, the beam shield element S2, and the support member 76 are made of metal, respectively, the support member 76 is integrally fixed to the electrode 74 and the beam shield element S2 respectively by spot welding. Of course, the support member 76 may be fixed to each of the electrode 74 and the beam shield element S2 by other mechanical fixing methods, such as a screw and a band.

The beam shield element S2 is arranged near the plasma P on the optical path of the laser beam L2, in order to absorb the laser beam L2 (see FIG. 8B), which passes through the plasma P generated within the bulb 7. Moreover, the beam shield element S2 is arranged in a position at which undesired electric discharge is not generated between the beam shield element S2 and the electrode 75 to which the beam shield element S2 is not fixed. Two or more V-shaped beam dampers S22, each of which becomes narrower in width gradually toward the inner side of the beam shield element S2, are formed on a surface S21 of a side of the beam shield element S2, where the laser beam L2, which passes through the plasma P, is irradiated. Since the beam dampers have the same structure as that of FIGS. 3A and 3B, description thereof is omitted.

Next, an operation of the laser driven light source 200 according to the second embodiment will be described, referring to FIG. 7. A breakdown occurs between the electrodes 74 and 75 by impressing high voltage to the pair of electrodes 74 and 75 in the bulb 7, and preliminary electric discharge is formed at the intermediate position between the electrodes 74 and 75. In this state, the laser source 4 emits the laser beam L1 towards the optical system component 2. The laser beam L1 is focused at the intermediate position between the electrodes 74 and 75 within the bulb 7 by the optical system component 2, and is irradiated to the preliminary electric discharge generated at the intermediate position between the electrodes 74 and 75. When the laser beam L1 is irradiated to the preliminary electric discharge at the intermediate position between the electrodes 74 and 75, the plasma P with high intensity is generated. Light LX emitted from the plasma P is reflected in a direction parallel to the optical axis LA by the reflective surface 11 of the concave reflecting mirror 1, and emitted to the outside of the concave reflecting mirror 1 from the light emission aperture 12. As shown in FIG. 8B, the laser beam L2, which passes through the plasma P without being absorbed thereby, enters the beam shield element S2 arranged in the sealed space 77 of the bulb 7, and as mentioned above, it is reflected and guided many times inside each V-shaped beam damper S22 (refer to FIG. 3B), and finally absorbed thereby so as to attenuate.

As shown in FIG. 8A, as mentioned above, in the laser driven light source 200 according to the second embodiment of the present invention, even though the laser beam L1 emitted from the laser source 4 passes through the plasma P, since the laser beam L2, which passes through the plasma P, is absorbed by the beam shield element S2 arranged on the optical path, the laser beam L2, which passes through the plasma P, is not simultaneously emitted from the plasma P together with the light LX. Therefore, according to the laser driven light source 200 of the present embodiment, there is no problem that peripheral devices are exposed to the laser beam L2, which passes through the plasma P generated in the bulb 3, so that they may be destroyed.

According to the laser driven light source 200 of the present embodiment, since the bulb 7 is heated when the beam shield element S2 absorbs the laser beam, which passes through the plasma P without being absorbed by the plasma P, so that heat is generated, the vapor pressure of the light emission metal enclosed in the bulb 3 is more rapidly increased and stabilized at a high value, so that the plasma P generated in the bulb 3 is not extinguished and maintained, and so that light with a stable output can be emitted from the plasma P.

Figure 9:
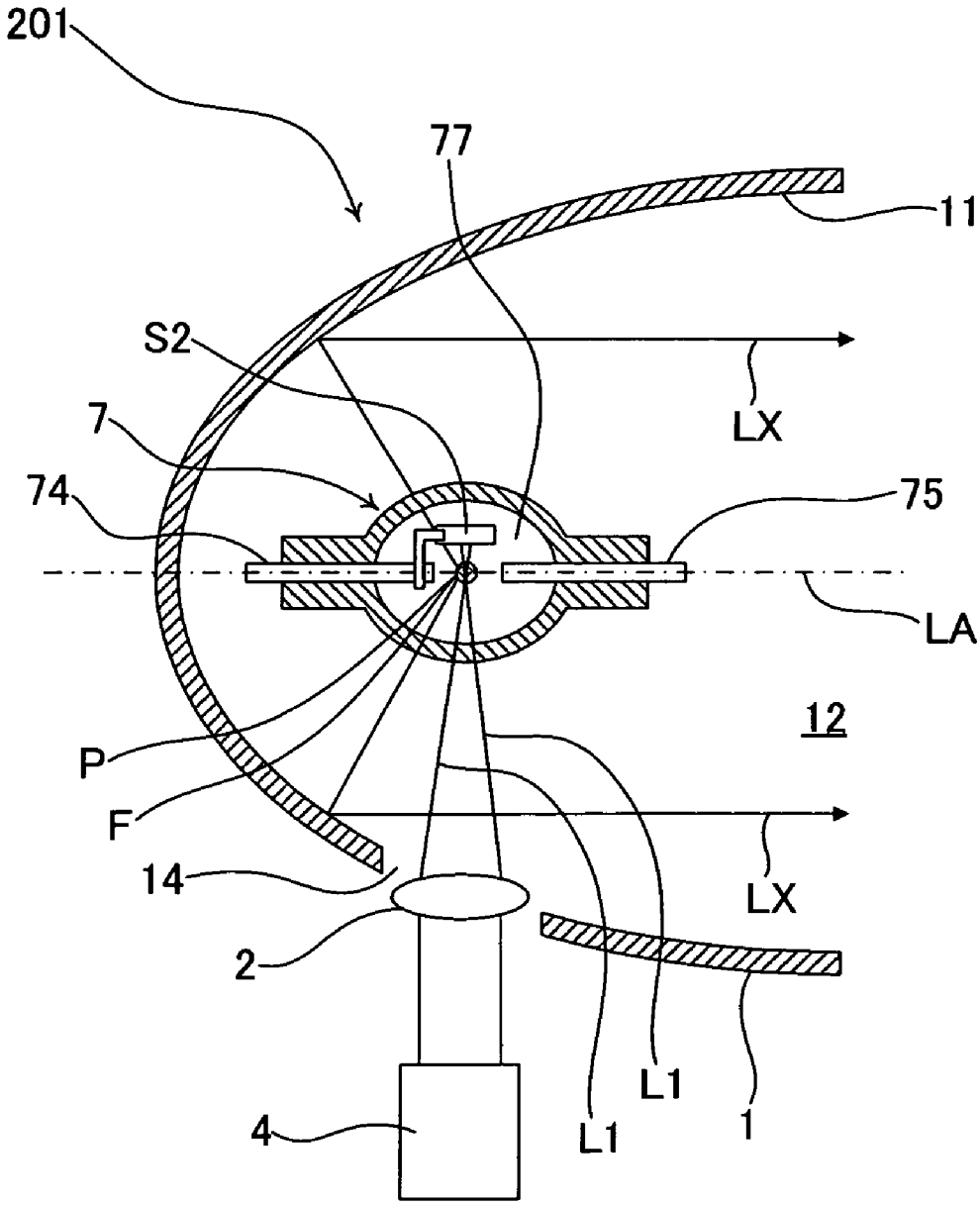
FIG. 9 is a diagram showing a modified example of a laser driven light source according to a second embodiment of the present invention.
Figure 10:
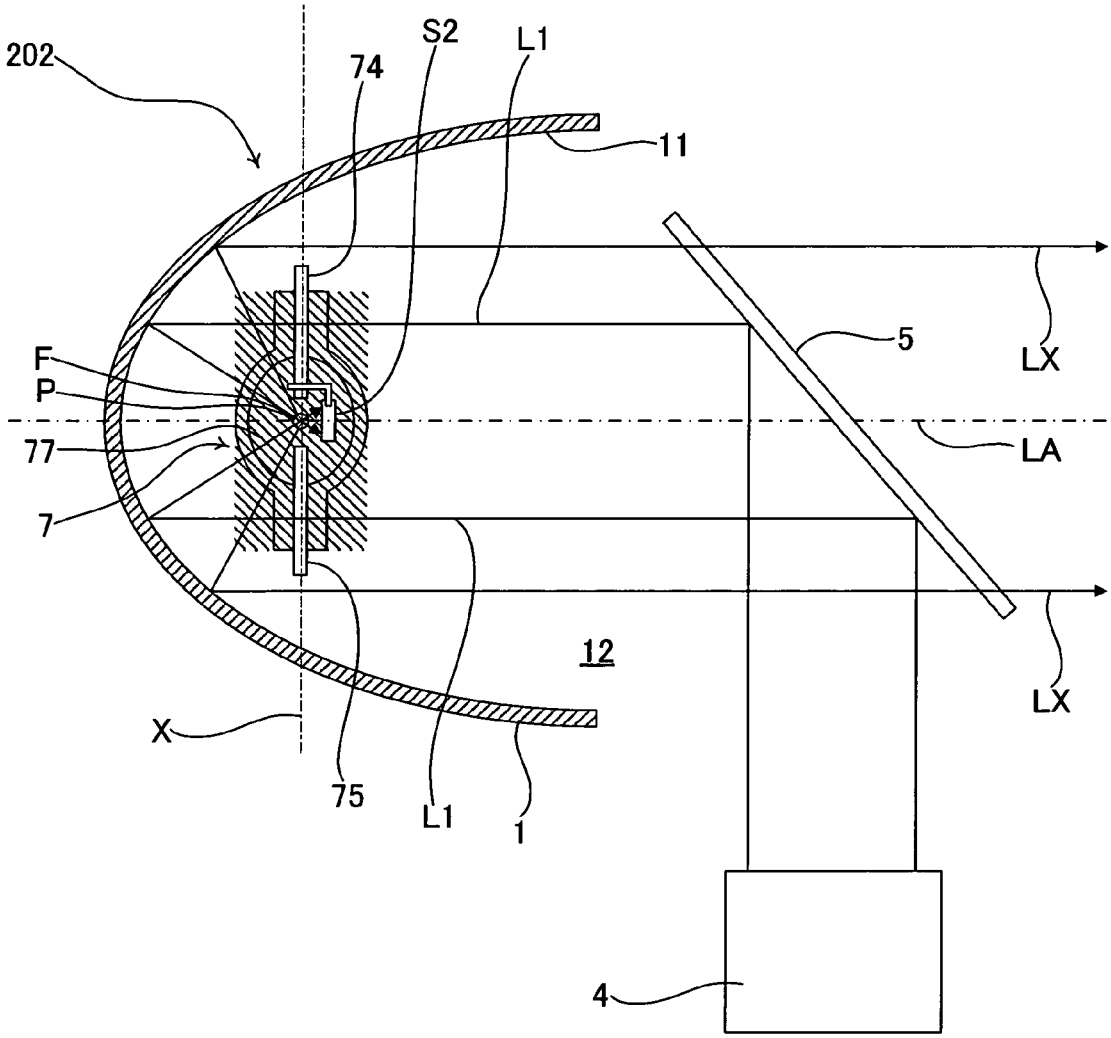
FIG. 10 is a diagram showing another modified example of a laser driven light source according to a second embodiment of the present invention.

FIGS. 9 and 10 show a cross sectional view of a modified example of the laser driven light source according to the second embodiment of the present invention.

In laser driven light sources 201 and 201 shown in FIGS. 9 and 10, only an incident path of a laser beam in a bulb 7 is different from that of the laser driven light source 200 shown in FIG. 7. Therefore, in FIGS. 9 and 10, the same numerals as those of FIG. 7 are assigned to the same elements as those of the laser driven light source shown in FIG. 7, and the description of those same elements is omitted. As shown in FIG. 9, the laser driven light source 201 comprises a concave reflecting mirror 1, which is in a bowl-shaped as a whole and has a light emission aperture 12; an optical system component 2 for focusing a laser beam L1 toward a bulb 7; the bulb 7, which is arranged at a focal point F of the concave reflecting mirror 1; and a laser source 4, which emits the laser beam L1 toward the bulb 7. The concave reflecting mirror 1 has a reflective surface 11 having a paraboloid-of-revolution shape; the light emission aperture 12 for letting out light, which a plasma P emits; and a side opening 14 for arranging the optical system component 2 therein.

The bulb 7 is arranged at the focal point F of the concave reflecting mirror 1 so that a tube axis X becomes parallel to an optical axis LA of the concave reflecting mirror 1. V-shaped beam dampers S22 shown in FIGS. 3A and 3B are formed on a beam shield element S2. A beam shield element S2 is arranged near the plasma P on the optical path of the laser beam, which passes through the plasma P, so that the tube axis X of the beam shield element S2 becomes parallel to the optical axis LA of the concave reflecting mirror 1.

In the laser driven light source 201 shown in FIG. 9, the laser beam L1 that is emitted from the laser source 4 is focused by the optical system component 2 arranged in the side opening 14 of the concave reflecting mirror 1 so that the bulb 7 is irradiated therewith. The high temperature plasma P is generated at the focal point F of the concave reflecting mirror 1 in the sealed space 77 of the bulb 7 by exciting a discharge medium enclosed in the bulb 7. Light LX emitted from the plasma P is reflected in a direction parallel to the optical axis LA of the concave reflecting mirror 1, and emitted to the outside of the concave reflecting mirror 1 from the light emission aperture 12. On the other hand, the laser beam, which passes through the plasma P without being absorbed thereby, enters the beam shield element S2 arranged in the sealed space 77 of the bulb 7, and, as mentioned above, the laser beam is reflected and guided many times inside the V-shaped beam dampers S22 shown in FIG. 3B, and finally absorbed thereby.

As shown in FIG. 10, the laser driven light source 202 comprises a concave reflecting mirror 1, which is in a bowl-shape as a whole and has a light emission aperture 12; a bulb 7 that is arranged at a focal point F of the concave reflecting mirror 1, so that a tube axis X thereof may be perpendicular to an optical axis LA of the concave reflecting mirror 1; a laser source 4 that emits a laser beam L1 toward the bulb 7; and a reflective member 5 that reflects the laser beam L1 emitted from the laser source 4 toward the bulb 7 and transmits the light LX emitted from the plasma P.

The concave reflecting mirror 1 is equipped with a reflective surface 11 of a paraboloid-of-revolution shape, and the light emission aperture 12, which emits light emitted from the high temperature plasma P. The reflective member 5 is arranged on the optical path of the light LX emitted from the high temperature plasma P so as to be inclined with respect to the optical axis LA of the concave reflecting mirror 1. The reflective surface 11 made from a dielectric multilayer film, which transmits the light LX emitted from the plasma P and reflects the laser beam L1 toward the bulb 7, is formed on a surface of the reflective member 5. Since the reflective surface made from the dielectric multilayer film that is formed on the reflective member 5 is the same as the reflective surface 11 of the concave reflecting mirror 1 and it is described above, description thereof is omitted.

In the laser driven light source 202 shown in FIG. 10, the laser beam L1 emitted from the laser source 4 is in series reflected on the reflective member 5 and the reflective surface 11 of the concave reflecting mirror 1, so that the bulb 7 is irradiated therewith, whereby the high temperature plasma is generated at the focal point F of the concave reflecting mirror 1 in the sealed space 77. The light LX emitted from the plasma P is reflected in a direction parallel to the optical axis LA of the concave reflecting mirror 1, and emitted to the outside of the concave reflecting mirror 1 from the light emission aperture 12. On the other hand, the portions of the laser beam, which pass through the plasma P without being absorbed thereby, enter the beam shield element S2 arranged in the sealed space 77 of the bulb 7, and as mentioned above, those portions are reflected and guided many times inside the V-shaped beam damper S22 (refer to FIG. 3B, and finally absorbed thereby so as to attenuate.

Third Embodiment

Figure 11:
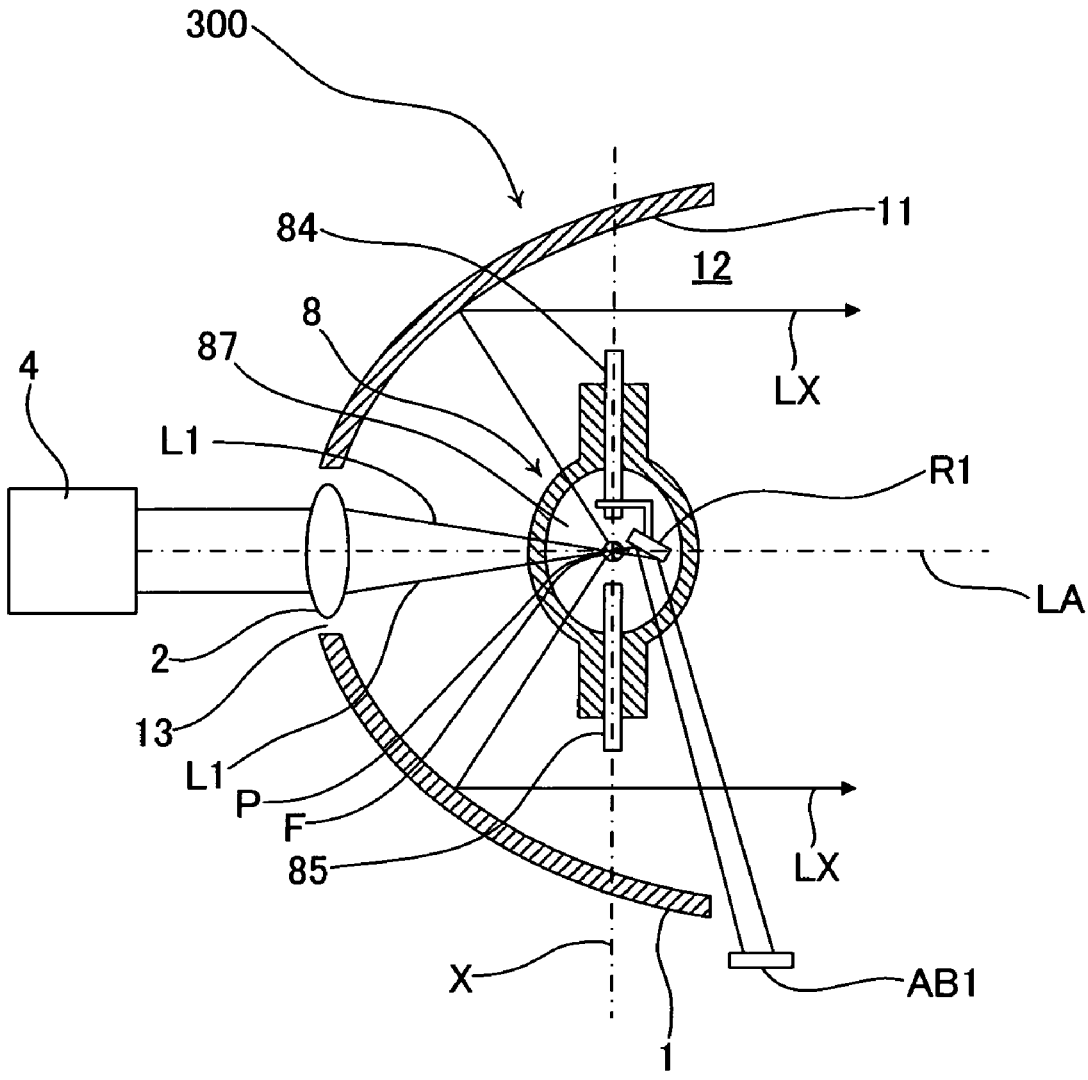
FIG. 11 shows a basic configuration diagram of a laser driven light source according to a third embodiment of the present invention.

FIG. 11 shows a basic configuration diagram of a laser driven light source according to a third embodiment of the present invention. The laser driven light source according to the present embodiment is an electrode type light source that has electrodes in a bulb. Moreover, the laser driven light source according to the present embodiment is different from the laser driven light sources according to the first and second embodiments, in that a beam shield element for shielding, which reflects a laser beam that passes through the plasma without being absorbed by the plasma, is provided in the bulb. (The laser driven light source according to the first and second embodiments has the beam shield element arranged in the bulb, which has a shield function, by absorbing the laser beam passing through the plasma without being absorbed by the plasma). In FIG. 11, the same numerals as those of FIG. 7 are assigned to the same elements of the laser driven light source 300 as those of the laser driven light source 200 shown in FIG. 7, and the description of those same elements is omitted.

The laser driven light source 300 comprises a concave reflecting mirror 1, which is in a bowl-shape as a whole and has a light emission aperture 12; a bulb 8, which is arranged at a focal point F of the concave reflecting mirror 1, so that a tube axis X thereof may be perpendicular to an optical axis LA of the concave reflecting mirror 1; an optical system component 2 for focusing the laser beam L1 emitted from a laser source 4 to the bulb 8; the laser source 4 that emits a laser beam L1 toward the bulb 8; and a beam absorption element AB1 that is arranged outside the concave reflecting mirror 1.

The concave reflecting mirror 1 has a reflective surface 11 having a paraboloid-of-revolution shape, the light emission aperture 12 for letting out light LX, which a plasma P emits, and a back side opening 13 for arranging the optical system component 2 therein. In the laser driven light source 300 according to the present embodiment, the laser source 4, the optical system component 2, and the bulb 8 are, in that order, arranged on the optical path of the laser beam L1 so as to be aligned in a straight line of the optical axis LA of the concave reflecting mirror 1.

Figure 12A:
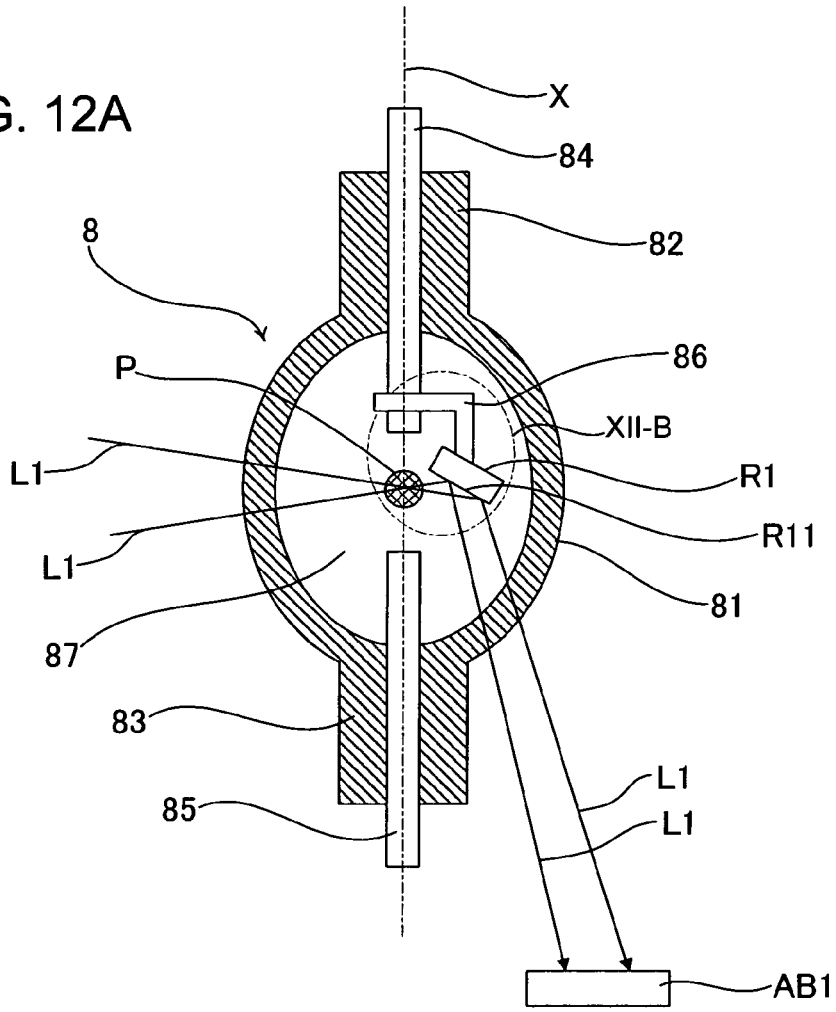
Figure 12B:
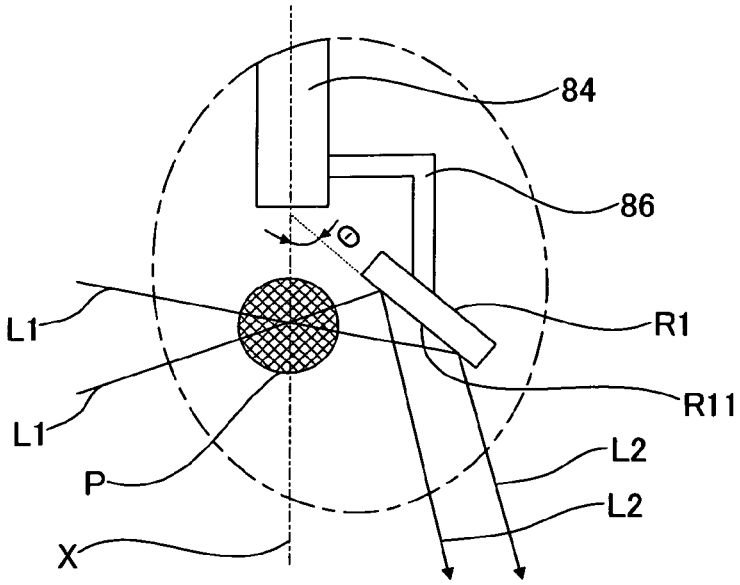
Figure 13:
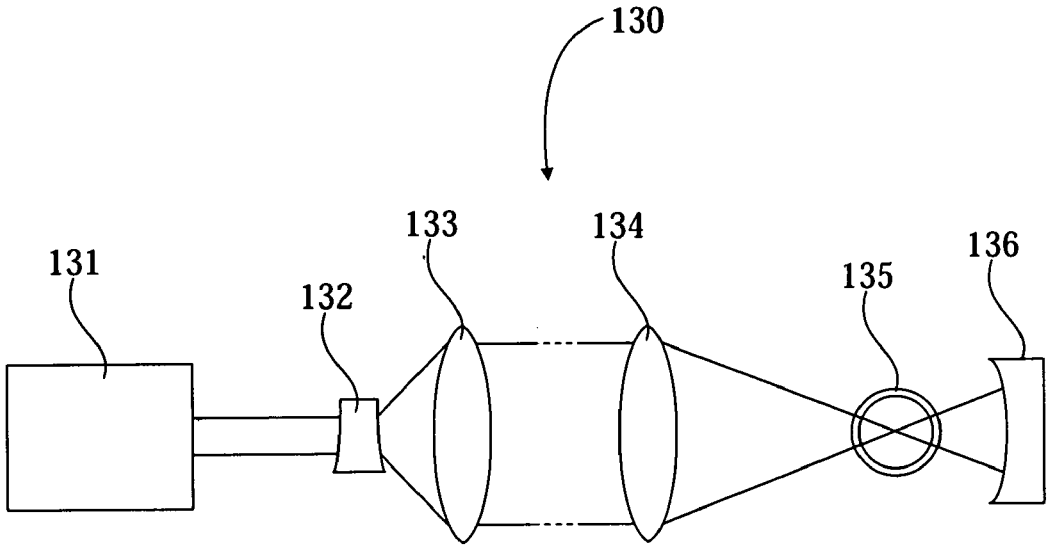
FIG. 13 (PRIOR ART)
FIG. 13 shows a basic configuration diagram of a conventional laser driven light source.

FIG. 12A is a schematic cross sectional view showing the structure of the bulb 8 of the laser driven light source 300 shown in FIG. 11 together with the beam absorption element AB1. FIG. 12B is a partially enlarged view of a portion XII-B of FIG. 12A. The bulb 8 shown in FIG. 12A has a light emission section 81 made of, for example, quartz glass, rod-shaped sealing portions 82 and 83, which continuously extend in a tube axis direction X respectively from the both ends of the light emission section 81, a sealed space 87 formed inside the light emitting section 81, rod-shaped electrodes 84 and 85 buried in the respective sealing portions 82 and 83 of the light emitting section 81, a beam shield element R1 (refer to FIG. 12B) for shielding, which is arranged in the sealed space 87 and reflects the laser beam L2 passing through the high temperature plasma P, and a support member 86 for fixing the beam shield element R1 to the electrode 84.

In the bulb 8, the high temperature plasma P is generated at the intermediate position of the electrodes 84 and 85 by impressing high voltage between the electrodes 84 and 85. The light LX emitted from the plasma P is emitted in a direction parallel to the optical axis LA of the concave reflecting mirror 1 to the outside of the concave reflecting mirror 1 from the light emission aperture 12.

As shown in FIG. 12B, the beam shield element R1 is fixed to the electrode 84 so as to be inclined with respect to the tube axis X by the support member 86, which is formed in a shape of hook as a whole. The beam shield element R1 has a reflective surface R11 that is made from a dielectric multilayer film and is formed on a substrate made of high melting point metal such as tungsten, tantalum, and molybdenum. The material and the number of films of the dielectric multilayer film is suitably designed so that the reflective surface R11 may reflect most of the laser beam L1 emitted from the laser source 4, to the outside of the concave reflecting mirror 1, without being absorbed thereby. In addition, the reflective surface R11 of the beam shield element R1 is not limited to the dielectric multilayer film that is described above, and it may be a member having a mirror finish surface which is produced by grinding a surface of a substrate made of, for example, high melting point metal.

Such a beam shield element R1 is arranged near the plasma P on the optical path of the laser beam L2, which passes through the high temperature plasma. Moreover, the beam shield element R1 is arranged in a position where undesired electric discharge may not be generated between the electrode 85 to which the beam shield element R1 is not fixed and the beam shield element R1.

As shown in FIG. 11, the beam absorption element AB1 for absorbing and attenuating the laser beam L2 reflected by the beam shield element R11 is provided near an opening end edge of the light emission aperture 12 of the concave reflecting mirror 1. Beam dampers S22 having V-shaped grooves shown in FIG. 3B are formed on a laser beam incidence plane of the beam absorption element AB1. As shown in FIG. 12A, an angle Θ formed by the reflective surface R11 of the beam shield element R1 and the tube axis X of the bulb 8 is suitably set up so that the laser beam L1, which enters the reflective surface R11, may be reflected toward the beam absorption element AB1.

In the laser driven light source 300 according to the third embodiment of the present invention, as shown in FIG. 11, the high temperature plasma is generated at the intermediate position between the electrodes 84 and 85 so that the light LX, which is emitted from the plasma P, is reflected in a direction parallel to an optical axis LA by the concave reflecting mirror 1, so as to be emitted to the outside of the concave reflecting mirror 1 from the light emission aperture 12. On the other hand, as shown in FIG. 12A, the laser beam L2, which passes through the high temperature plasma without being absorbed the plasma, enters the reflective surface R11 of the beam shield element R1, which is arranged in the sealed space 87 of the bulb 8. Further, the laser beam L2 is reflected by the reflective surface R11 towards the beam absorption element AB1, which is provided outside the concave reflecting mirror 1, whereby as mentioned above, the laser beam is reflected and guided many times inside the V-shaped grooves of the beam dampers S22 so that it is finally absorbed by the beam dampers S22 provided on the beam absorption element AB1. Thus, the laser beam L2, which passes through the plasma P, is reflected by the beam shield element R1 to the outside of the concave reflecting mirror 1, and is finally absorbed and attenuated by the beam absorption element AB1.

In the laser driven light source 300 according to the third embodiment of the present invention, as shown in FIG. 11, the laser beam L2, which passes through the plasma P generated in the bulb 8, is reflected by the beam shield element R1, to the outside of the concave reflecting mirror 1, and is absorbed by the beam absorption element AB1. Therefore, the laser beam L2, which passes through the plasma P, is not simultaneously emitted to the outside of the concave reflecting mirror 1 together with the light LX emitted from the plasma P. Therefore, according to the laser driven light source 300 of the present embodiment, there is no problem that peripheral devices are exposed to and destroyed by the laser beam L2, which passes through the plasma P generated in the bulb 8.

In addition, the beam shield element R1 is not necessarily used together with the beam absorption element AB1, which is arranged outside the concave reflecting mirror 1. For example, the beam shield element R1 may have a scattering reflective surface formed in concavo-convex form with a pearskin finish on the surface of a substrate made of any of copper, aluminum and silver. Moreover, a scattering reflective surface may be formed by forming a surface in concavo-convex form with the pearskin finish on a surface of a substrate made of resin, which is excellent in heat resistance and processability, and applying metal consisting of any of copper, aluminum and silver, to the surface of the substrate.

In such a case, since the laser beam L2, which passes through plasma P without being absorbed by the plasma, is blocked by carrying out diffuse reflection towards the circumference of the scattering reflective surface after it enters the scattering reflective surface of the beam shield element R1, the above-mentioned beam absorption element AB1 may be omitted.

The preceding description has been presented only to illustrate and describe exemplary embodiments of the present laser driven light source. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to any particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A laser driven light source comprising:

a bulb that encloses a discharge medium;

a laser beam unit that emits a laser beam;

and a beam shield element that is within the bulb, wherein the laser beam is focused in the bulb for generating a discharge therein, and wherein the beam shield element is perpendicular to the optical axis of the laser beam in a side of the sealing portion which is located in a direction in which the laser beam travels from the focal point and is located away from the focal point of the laser beam, and the beam shield element blocks portions of the laser beam that pass through plasma.

2. The laser driven light source according to claim 1, wherein the discharge medium contains metal and the beam shield element is heated by absorbing portions of the laser beam that pass through the plasma.

3. The laser driven light source according to claim 2, wherein a beam damper is formed on the beam shield element, the beam damper absorbs portions of the laser beam that pass through the plasma by reflecting thereinside.

4. The laser driven light source according to claim 2, wherein a surface of the beam shield element is modified for absorbing the laser beam that pass through the plasma.

5. The laser driven light source according to claim 2, wherein a surface of the beam shield element has concaves and convexes thereon, a pitch of the concaves and the convexes being in a range of 1 μm to 1 mm.

6. The laser driven light source according to claim 2, wherein a tungsten powder is sintered on the surface of the beam shield element that is irradiated by the portions of laser beam that pass through the plasma.

7. The laser driven light source according to claim 2, wherein the beam shield element is made of at least one of metals of tungsten, molybdenum, tantalum, and rhenium.

8. The laser driven light source according to claim 2, wherein the discharge medium contains mercury.

9. The laser driven light source according to claim 1, wherein the discharge medium contains mercury and at least one rare gas.

10. The laser driven light source according to claim 1, wherein the beam shield element is held by a support element that projects from an inner surface of the bulb, and wherein the support element is made of at least one metal selected from a group of metals consisting of tungsten, molybdenum and tantalum.

11. The laser driven light source according to claim 1, wherein a pair of electrodes is provided facing each other in the bulb.

12. The laser driven light source according to claim 11, wherein the beam shield element is held by the support element fixed to the electrode, and wherein the support element is made of at least one metal selected from the group of metals consisting of tungsten, molybdenum and tantalum.

13. The laser driven light source according to claim 1, wherein the beam shield element has a reflection surface for reflecting the portions of the laser beam passing through the plasma.

14. The laser driven light source according to claim 13, wherein the reflection surface of the beam shield element has a scattering reflection characteristic.

15. The laser driven light source according to claim 13, wherein a beam absorption element is provided outside the bulb to absorb the laser beam reflected from the reflection surface of the beam shield element.

16. The laser driven light source according to claim 1, wherein a concave mirror for reflecting light emitted from the plasma is provided so that the discharge medium is located at a focus point of the concave mirror.

17. The laser driven light source according to claim 16, wherein the concave mirror has an aperture through which the laser beam passes, and an optical element for focusing the laser beam in the bulb is provided near the aperture.

* * * * *